United States Patent [19]

Polhemus et al.

[11] 4,353,470

[45] Oct. 12, 1982

[54] VERTICALLY STACKABLE TRAY SET

[75] Inventors: Marlan H. Polhemus, Chicago; Peter L. Ferrante, Evanston, both of Ill.

[73] Assignee: Tenex Corporation, Elk Grove Village, Ill.

[21] Appl. No.: 125,345

[22] Filed: Feb. 28, 1980

[51] Int. Cl.[3] ..... A47F 3/14

[52] U.S. Cl. ..... 211/126; 211/11; 312/111

[58] Field of Search ..... 108/531, 91, 154, 155; 206/821, 503, 509–512; 220/23.4, 23.6; 312/111, 257 R; 211/126, 133, 11, 10, 49

[56] References Cited

U.S. PATENT DOCUMENTS

| | | | |
|---|---|---|---|
| 1,957,153 | 5/1934 | Smiley | 211/126 |
| 1,957,153 | 5/1934 | Smiley | 220/97 |
| 2,406,665 | 8/1946 | Churchill | 24/213 B |
| 2,915,353 | 12/1959 | Michaelsen | 211/49 R |
| 3,003,839 | 10/1961 | Bloom | 312/111 |
| 3,533,512 | 10/1970 | Serwer | 211/126 |
| 3,568,848 | 3/1971 | Talkansky | 211/41 |
| 3,584,744 | 6/1971 | Ettlinger | 211/126 |
| 3,606,506 | 9/1971 | Ungaro | 312/111 |
| 3,760,937 | 9/1973 | Van Wyngarden | 220/23.6 |
| 4,074,810 | 2/1978 | Tuergens | 211/11 |
| 4,138,015 | 2/1979 | Rabley | 206/561 |

FOREIGN PATENT DOCUMENTS 973724 11/1964 United Kingdom .

*Primary Examiner*—Price C. Faw, Jr.
*Assistant Examiner*—Henry E. Raduazo
*Attorney, Agent, or Firm*—Hosier, Niro and Daleiden, Ltd.

[57] ABSTRACT

This is a desk top tray set comprising trays and connector-spacer members for connecting the trays in vertically stacked relationship two or more tiers high. Each tray has a versatility that makes it universally applicable either for individual use or for positioning anywhere in the vertical stack. That is to say, a given tray, when equipped with removeable and replaceable plugs for the upwardly facing bayonet ports thereof, can be used individually or as the topmost tray in a vertical stack. When the bayonet plugs are removed, however the tray can be used in the interior or at the bottom of the stack. Moreover the plugs, once removed can again be replaced, and the tray thus restored to the top of the stack or to individual use. The tray is also designed to receive connector bayonets plugged in from above or below, so that each tray can be used at the top, in the middle, or at the bottom of the stack. In particular, when the trays are used in the middle of a stack, they are able to receive bayonets plugged in from above and below simultaneously. The up and down bayonets are interdigitated within the interior wall spaces of the trays, and make different types of snap fit interconnections with a retaining structure within the interior wall space below the bayonet entry ports.

6 Claims, 15 Drawing Figures

46A
46
44
32
34
28B
28A
60
52
27
80
30
84
36
68
54
38
72
74
42
24
76
40
66
20
28
46
27
30
26
26A
22

4

50
56
58
64
59
82

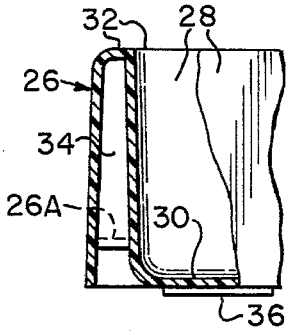
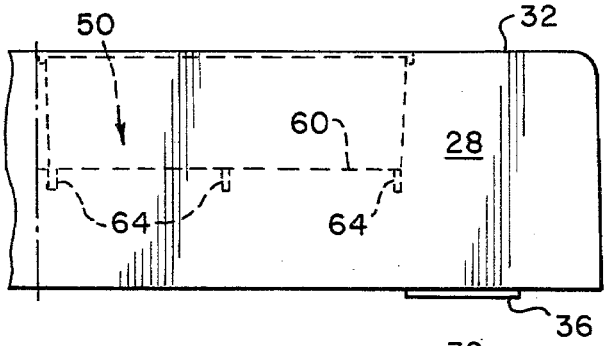
FIG. 9
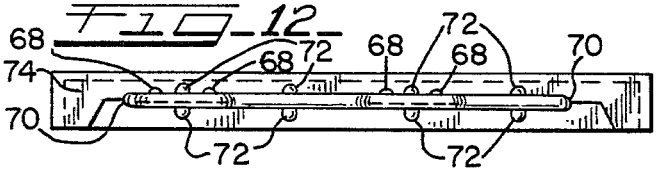
FIG. 12
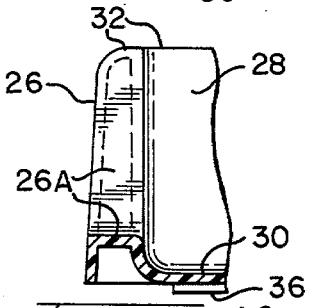
FIG. 10
FIG. 11
FIG. 13
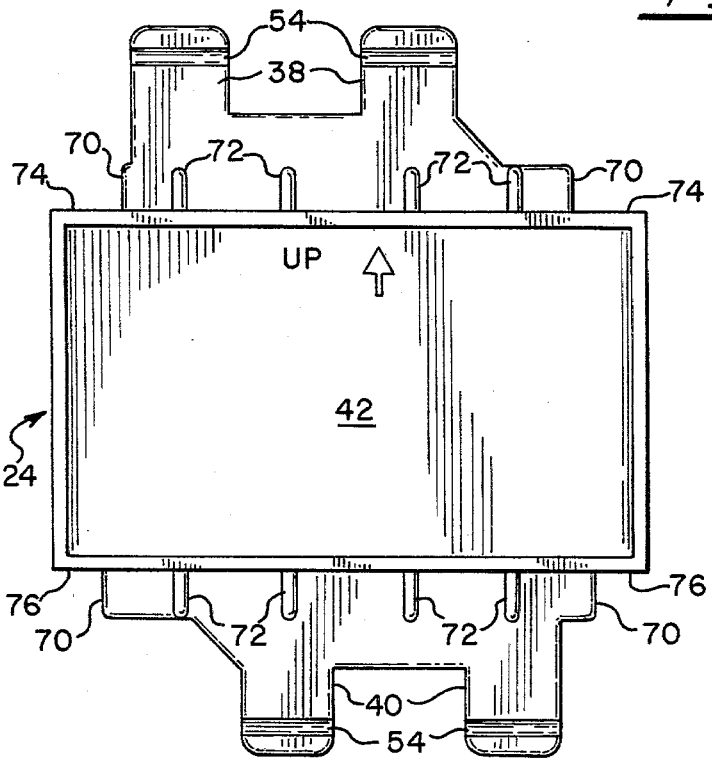
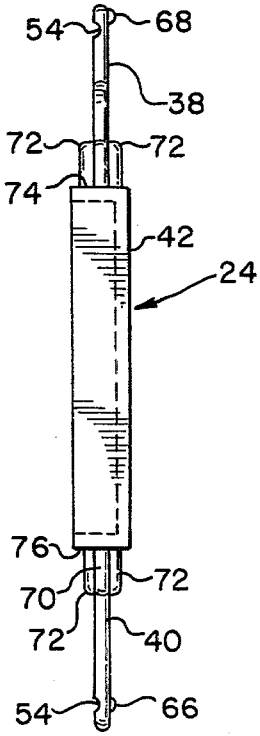

VERTICALLY STACKABLE TRAY SET

This invention relates generally to stackable trays, and particularly to trays of the type commonly used as desk-top in and out boxes.

BACKGROUND OF THE INVENTION

Vertically stackable tray sets are well known, and one of the most common applications of such sets is for use as multi-level in and out boxes which sit atop an office desk. Such tray sets in the past have included an upper tray, a lower tray, and a tray connector which is secured in some fashion to the bottom of the upper tray and the top of the lower tray. The function of the connector is to keep the two trays in assembled relationship with each other. In addition, the connector often serves the function of spacing the two trays vertically from each other so that the amount of material which can be stored in the vertical space between the two trays is increased. An example of such a tray set is seen in Juergens U.S. Pat. No. 4,074,810.

It is also known that the trays may be formed with double walls having interior spaces for receiving one or more bayonet members formed at the upper and lower ends respectively of the connector/spacer member. These bayonets are plugged into the space between the tray walls, entering through upper and lower ports formed in the walls for that purpose. An example of a tray set constructed in this fashion is seen in Serwer U.S. Pat. No. 3,533,512.

One of the disadvantages of this type of construction is that the topmost tray of the vertical stack has an unsightly upwardly facing port opening which is designed to accommodate the connector bayonet for another tier of trays which, however, are not going to be used. It is desirable that some means be provided to close the upwardly facing port opening of the topmost tray. (In speaking of the "topmost tray" this reference is intended to include not only the uppermost tier of a multi-level stack, but is also intended to include a single tray which is not stacked at all.) Furthermore, it is desirable that the upwardly facing port not be closed off by an integrally molded plug which is designed to be broken out in order to permit insertion of the connector bayonet. If the plug must be broken out, then the user cannot thereafter change his or her mind, and restore the plug to its former position. As a result, if a particular tray is first used as a lower level tier of a stack, it cannot thereafter be converted to use as a topmost tray without displaying an unsightly upwardly facing port opening.

SUMMARY OF THE INVENTION

In accordance with this invention, there is provided a vertically stackable tray set which is adapted to sit upon a horizontal surface, such as a desk. The tray set comprises at least one tray having upstanding wall means including an upper rim, and at least one space in the interior of the wall means below the upper rim. This space is adapted for receiving the bayonet portion of a tray connector. A port opening extends through the upper rim of the wall means and communicates with the interior space therein, to permit the bayonet to be inserted into the interior space from above. A plug means is provided, which is formed separately from the wall means, and therefore is removably and replaceably received within the bayonet port. This permits the plug to be removed without fracturing any of the tray material, and thus allows replacement of the plug if the tray is later converted from use as a lower level tier to use as an uppermost or single tier. Preferably the plug has a surface which is substantially a continuation of the surface of the upper rim when the plug is received within the bayonet port, so that the bayonet port is disguised with maximum cosmetic effect.

Another aspect of the invention involves the means of securing the bayonet within the interior wall space. In accordance with this invention a first upright surface within the interior space and a first side of the bayonet have respective means thereon which are adapted for a snap interfit. In addition, a second upright surface within the interior space, which confronts the first upright surface, and a second side of the bayonet, which faces oppositely to the first side, have respective means thereon which are adapted to interengage for crowding the snap interfitting means into engagement with each other. In a preferred embodiment of the invention, this latter means takes the form of a step having a tread surface and a riser surface. The tray connector actually has at least two bayonets, at least one pointing upwardly and another one pointing downwardly, and the means on the up bayonet interengage somewhat differently with the step structure than the corresponding means on the down bayonet. One of them rides down the stair riser, while the other one rides up the stair riser and onto the tread.

An additional feature of the invention involves the provision of plural up bayonets and plural down bayonets, which are so arranged that when both types of bayonets are inserted into the same interior wall space, they interdigitate with each other.

Finally, the invention contemplates the provision of guide means on the tray connector which interfit with the major dimension, and preferably also the minor dimension, of the elongated bayonet port.

These and other features of the invention will be more fully appreciated from the following detailed description of a preferred embodiment when taken in conjunction with the accompanying drawings.

BRIEF DESCRIPTION OF THE DRAWINGS

FIG. 9 is a side elevational view, with parts broken away for clarity of illustration, of one of the trays of the preceding figures. The viewing plane and direction of view of FIG. 9 are indicated by lines 9—9 of FIG. 3, and the accompanying arrows.

FIG. 10 is a fragmentary sectional view taken along the lines 10—10 of FIG. 3, looking in the direction of the arrows.

FIG. 11 is a rear elevational view of one of the spacer-connector members employed in the tray set of this invention.

FIG. 12 is a top plan view of the spacer-connector member.

FIG. 13 is a side elevational view of the spacer-connector member.

DETAILED DESCRIPTION OF THE PREFERRED EMBODIMENT

Figures 1, 2, 5, 8:
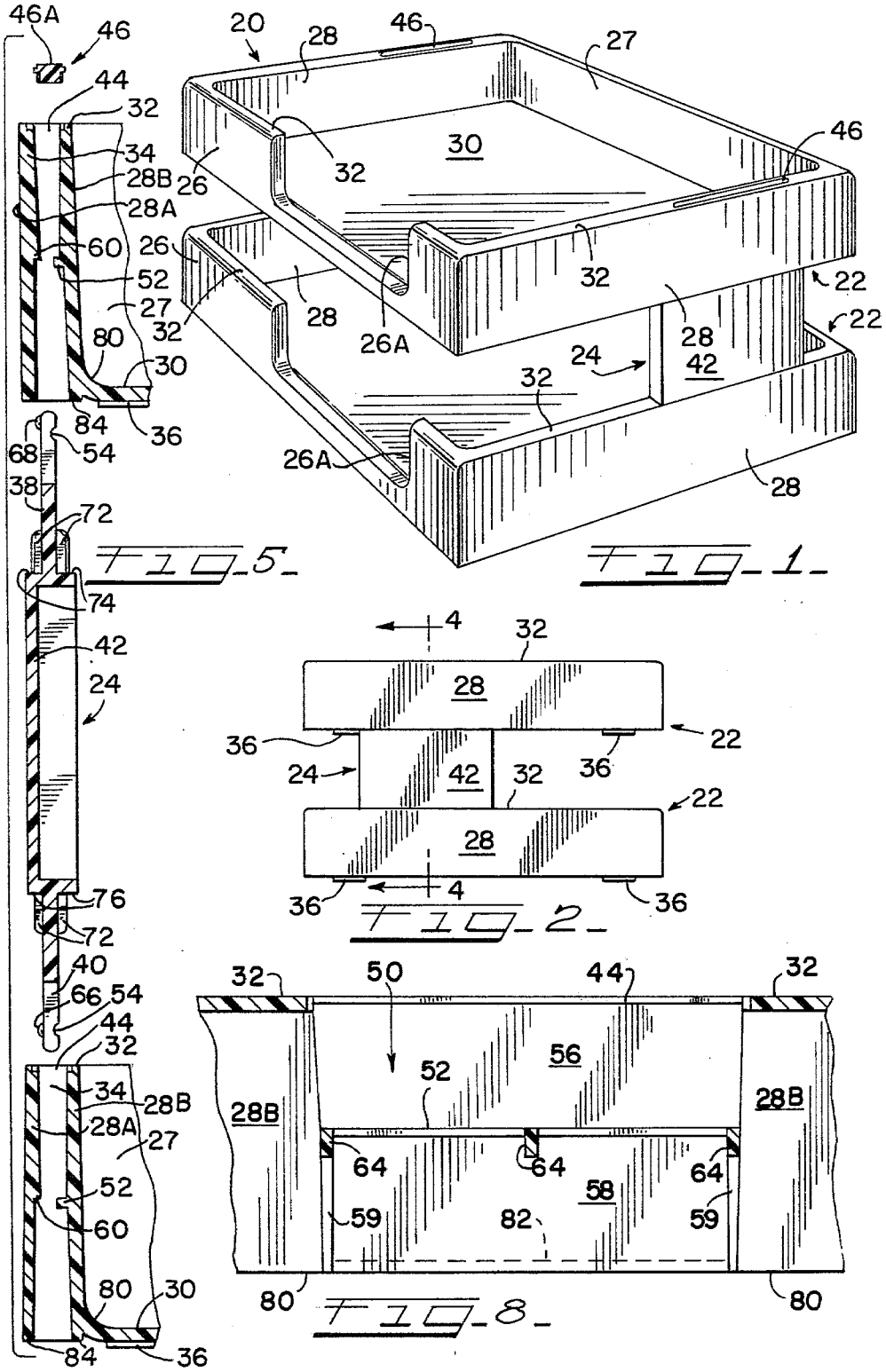
FIG. 1 is a perspective view of a two-tier stack of trays including a tray connector and spacer device, all in accordance with the present invention.
FIG. 2 is a side elevational view of the same two-tier tray structure.
FIG. 5 is a sectional view similar to that of FIG. 4 in all respects, except that the parts are disassembled.
FIG. 8 is a fragmentary sectional view, taken along the lines 8—8 of FIG. 6, looking in the direction of the arrows.
Figure 3:
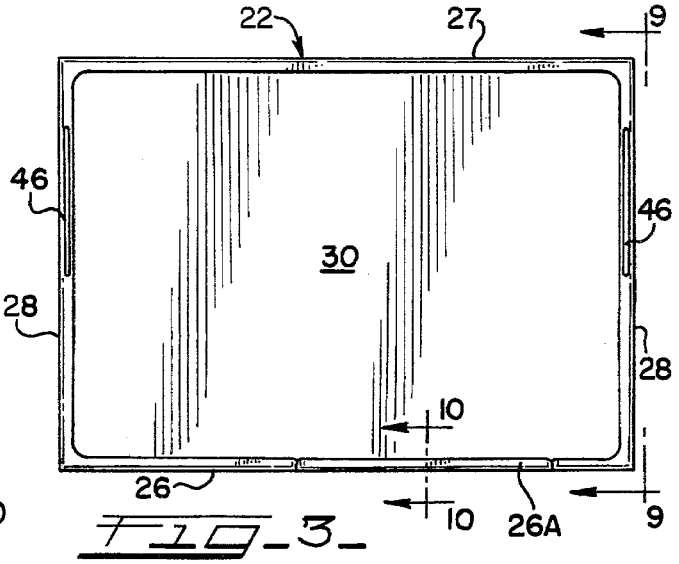
FIG. 3 is a top plan view of one of the trays of FIGS. 1 and 2.

A tray set 20 in accordance with this invention includes a plurality of individual trays 22 which are completely identical in construction. These trays may be used individually, in which case each one sits in a horizontal attitude upon a desk top or similar horizontal surface, or alternatively they are designed to be stacked vertically above one another as seen in FIGS. 1 and 2. In the latter case, the trays are connected to each other by means of a pair of connector members 24. The right side connector member is seen in FIG. 1, and the left side connector member in FIG. 2. The connector members 24 are, however, identical to each other in construction.

Each of the trays 20 has a front wall 26 which is formed with a cut-out 26A for ease of retrieval of documents from the tray. There are also a rear wall 27 and left and right side walls 28, all upstanding from the floor 30 of the tray. The four walls 26 through 28 are formed with an upper surface 32 which extends continuously around the tray except for the cut-out portion 26A.

With two exceptions which will be subsequently described, all the parts of each tray 22 are molded as a single integrally connected piece of conventional plastic material. Each of the upstanding walls 26 through 28 has a double wall construction with an interior space between the two individual walls. As best seen in FIG. 5, each side wall 28 is formed of an outer wall member 28A and an inner wall member 28B, between which is an interior space 34.

Each of the trays 22 is a universal tray, in the sense that it is adapted to be used either individually, i.e. not in vertical stacked relationship with any other trays, or in a vertical stack of two or more trays. In the latter instance, a given tray 22 is adapted to serve either as the bottommost tray in the stack, or the topmost tray in the stack. In addition, if the stack includes three or more trays, each tray is adapted to be at an intermediate level between the topmost and bottommost tray. In order to fit each tray for service individually, or as the bottommost tray in a vertical stack, there are provided footpads 36 made of felt or rubber which adhere to the bottom surface of the base 30 of each tray.

When the trays 22 are used in stacked relationship, each pair of vertically adjacent trays is secured together by a pair of connector members 24. Each connector is positioned between the tray above and the tray below, and is equipped with a pair of upwardly directed bayonets 38 and a pair of downwardly directed bayonets 40 (see FIGS. 5 and 11). In addition to the function of connecting the vertically adjacent trays 22 together in stacked relationship, the connector members 24 also serve the function of spacing them vertically apart, so as to increase the carrying capacity of the lower trays in the stack. For this purpose the members 24, which may be referred to as connector-spaced members, have a middle section 42 between the upwardly directed bayonets 38 and the downwardly bayonets 40, this middle section 42 serving to space the trays 22 vertically apart from each other.

Figure 4:
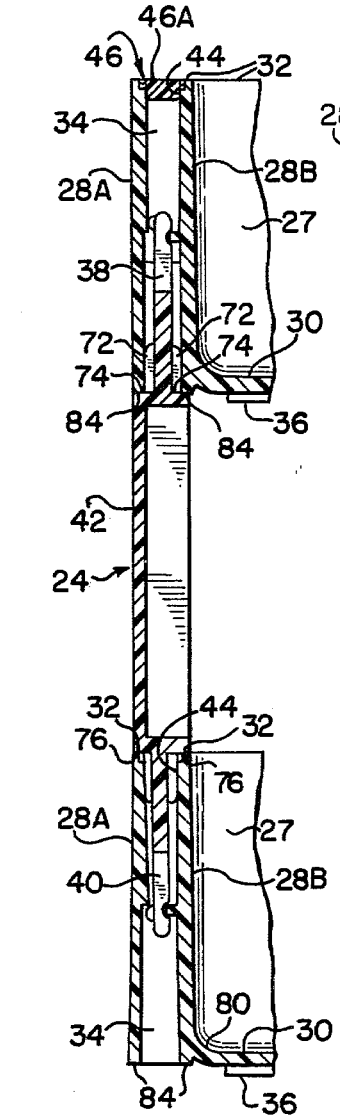
FIG. 4 is a fragmentary sectional view taken along the lines 4—4 of FIG. 2, looking in the direction of the arrows. This view shows the two trays assembled with the spacer-connector device.
Figure 6:
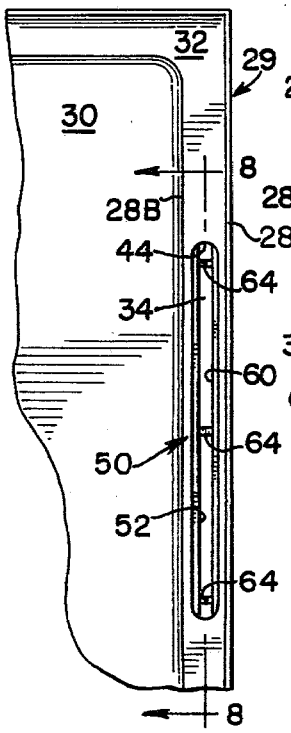
FIG. 6 is a top plan view of the open bayonet port of one of the trays of the preceding figures.
Figure 7:
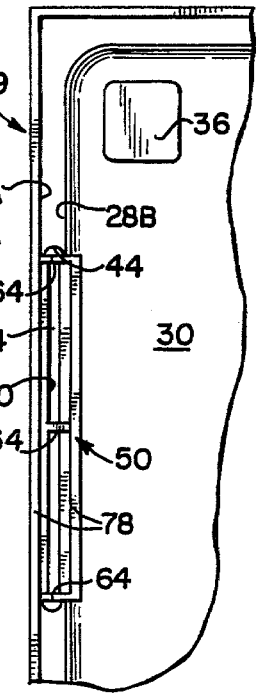
FIG. 7 is a bottom plan view of the same bayonet port.

The bayonets 38 and 40 plug into the interior spaces 34 of the tray side walls 28 and 29. In order to receive the upwardly directed bayonets 38, the interior wall space 34 opens downwardly all around the entire four walls 26 through 29 of each tray. In order to receive the downwardly directed bayonets 40, the upper rim 32 of each tray is interrupted, at two locations only, by upwardly facing bayonet ports 44 (see FIG. 5). But in order to prevent the upwardly opening bayonet ports 44 from marring the appearance of the uppermost 22 in any stack, or the appearance of a tray 22 which is used individually instead of in stacked relationship, the bayonet ports of these trays only are filled by plugs 46 (see FIGS. 1, 4 and 5). These plugs 46 are molded of plastic material, but are not formed integrally with the rest of the tray 22. Instead, they make a close friction fit with the edges of the bayonet port 44, so that the plugs 46 can be removed from the bayonet ports without the need for fracturing any of the molded material of the tray 22. When the plugs 46 are removed, then the down bayonets 40 of the spacer-connector members 24 can be plugged into the interior wall space 34 through the upwardly opening bayonet ports 44. But if the tray should then be converted to use either individually or as the topmost tray in a vertical stack, so that it then becomes necessary to cover the upwardly opening port 44, the plug 46 can easily be replaced, which would not be the case if the plug 46 had originally been molded integrally with the tray 22, and had to be fractured therefrom in order to open up the port 44 initially. The shape of the top surface 46A of the plug 46 is designed to be a continuation of the surface of the upper rim 32, so as to maximize the cosmetic appearance of the plug when it is inserted in place in the bayonet port 44.

Below each of the bayonet ports 44 and within the interior space 34 of both of the sidewalls 28 are located respective bayonet retaining structures 50, best seen in FIGS. 6 through 9. On the inner surface of inner wall sections 28B are formed horizontal ribs 52 projecting into the interior wall spaces 34 of both sidewalls 28. These ribs 52 are part of the bayonet retaining structure 50, and make detenting engagement with recesses 54 formed on the inside surfaces of both the up bayonets 38 and the down bayonets 40. Above the horizontal rib 52 the inside surfaces of inner wall sections 28B are formed with sloping portions 56 which permit the tray to be withdrawn from the upper part of the mold. Below the horizontal ribs 52 the inside surfaces of inner wall sections 28B are formed with oppositely sloping portions 58 which permit the tray to be withdrawn from the lower part of the mold. Each surface portion 58 is flanked by a pair of vertically extending guide ribs 59 formed on the inner surfaces of both wall sections 28B, which protrude into the interior wall spaces 34 for a purpose to be described below.

Figure 14:
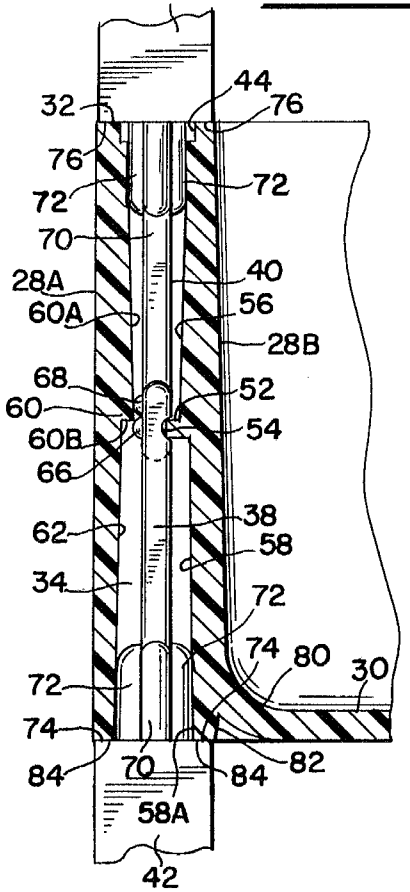
FIG. 14 is a sectional view taken through one of the interior wall spaces of one of the trays of this invention which is simultaneously connected to another such tray above it and still another such tray below it, showing the interconnection of the bayonets of the respective upper and lower spacer-connector members.

Also included in the bayonet retaining structure 50 is a step 60 which is formed on the inwardly facing surfaces of outer wall sections 28A. As best seen in FIG. 14, the step 60, using standard stairway construction terminology, includes a substantially vertical "tread" surface 60A and a substantially horizontal "riser" surface 60B. The tread surface 60A is sloped for withdrawal of the tray from the upper half of the mold, and a surface 62 below the step 60 formed on the inner surfaces of wall sections 28A and 29A is sloped the opposite way for withdrawal of the tray from the bottom half of the mold. The lower edge of step 60, i.e. the riser surface 60B, is at approximately the same horizontal level as the upper edge of the rib 52, this relationship being necessary so that the two structures 52 and 60 can cooperate with each other for retaining the bayonets 38 and 40 within the interior wall spaces 34, in a manner to be described below. The horizontal extent of the step 60, which is best seen in FIG. 9, is substantially equal to the horizontal extent of the rib 52, best seen in FIG. 8. In order for the lateral separation between the rib 52 and stop 60 to be accurately maintained, so that they function properly in relation to each other, there are a plurality of cross-webs (FIGS. 6–9) which bridge horizontally across the interior wall spaces 34 and are integrally joined to the inside surfaces of the confronting wall sections 28A and 28B.

As best seen in FIG. 13, the lower bayonets 40 of each connector-spaced member 24 have rounded projections 66 on the opposite side thereof from the recesses 54. Note that the rounded projection 66 and the recesses 54 of the down bayonet 40 are substantially at the same horizontal level. In contrast to this, the up bayonets 38 of each connector-spacer member 24 are formed with rounded projections 68; and although projections 68 are also on the opposite side of bayonet 38 from the recesses 54, they are somewhat vertically offset therefrom. Specifically, the horizontal center lines of rounded projections 68 are somewhat higher than the horizontal center lines of indentions 54. Thus, the locations of the projections 66 on the down bayonets 40 are not identical with the locations of the projections 68 of the up bayonets 38.

Figure 15:
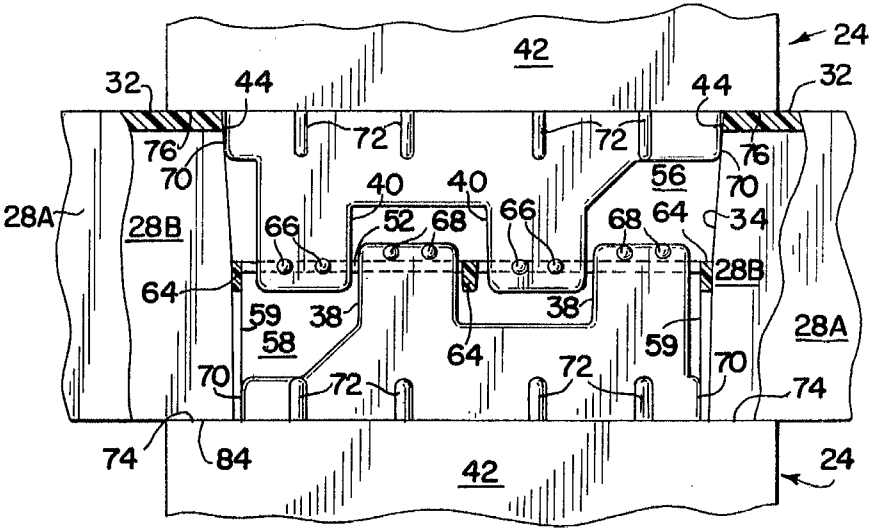
FIG. 15 is a side elevational view of the same interior wall space as in FIG. 14, with the exterior wall surface broken away to reveal the details of the bayonets and other structures therein.

Since each of the trays 22 is to have universal application, either as a top most tray, or a bottom most tray, or an intermediate tray in a vertical stack of three or more, it is essential that each interior wall space 34 directly below the bayonet ports 44, and each bayonet retaining structure 50 within those spaces, be adapted to receive either bayonets 38, or down bayonets 40, or in the case of an intermediate tray, both such bayonets simultaneously. FIG. 15 illustrates the manner in which the two up bayonets 38 of a lower spacer-connector member 24 interdigitate with the two down bayonets 40 of an upper spacer-connector member 24 within the same interior wall space 24 of a sidewall 28.

FIG. 14 best illustrates that when the up bayonets 38 and down bayonets 40 are both simultaneously inserted into the same interior wall space 34, the horizontal rib 54 makes a snap fit with the recesses 54 on the inside surfaces of both the up bayonets 38 and the down bayonets 40. In order to make this snap fit, however, the tips of the bayonets 38 and 40 have to be cammed against the horizontal rib 52, and this is accomplished by the interengagement between the rounded projections 66 and 68 and the step structure 60 which projects into the interior wall space 34 opposite the horizontal rib 54. The rounded projections 66 and 68, however, due to their different placement upon the bayonets 40 and 38, interact differently with the step structure 60. The rounded projections 68 of the up bayonets 38 ride upwardly past the riser surface 60B, over the point of the step structure 60, and onto the tread surface 60A. Once they reach that position, the impingement of the tread surface 60A against the rounded projections 68 forces the tips of the up bayonets 38 against the horizontal rib 52 so that it makes a snap interfit with the recesses 54 thereof. In the case of the down bayonets 40, however, the rounded projections 66 ride downwardly across downwardly across the tread surface 60A and over the point of the step structure 60, and descend part of the way down the riser surface 60B. They do not, however, ride all of the way down, and therefore the point of the step structure 60 continues to impinge upon the rounded projections 66, so that the tips of the bayonets 40 are forced against the horizontal rib 52, again causing the rib to make a snap interfit with the recesses 54.

The up bayonets 38 and down bayonets 40 of each spacer-connector member 24 are formed with guide surfaces 70. In the case of the down bayonets 40, these surfaces 70 slidably engage the extreme ends of the elongated bayonet ports 44 so as to guide the bayonets 40 into the proper positions as they go down into the interior wall spaces 34. In the case of the up bayonets 38, these surfaces 70 slidably engage the guide ribs 59 on either side, thus guiding the bayonets into the proper position as they go upwardly into the wall spaces 34. Thus, all the bayonets are properly located with respect to the major axis of the elongated bayonet ports 44.

In order to locate the bayonets with respect to the transverse dimension, or minor axis, of the bayonet ports, ribs 72 on the lateral surfaces of the bayonets 38 and 40 make similar sliding engagement with the inside surfaces of wall sections 28A and B. At the top of the interior wall spaces 34, near the ports 44, ribs 72 engage surfaces 56 and 60A. At the lower end of wall spaces 34 these ribs engage surfaces 58 and 62. Since the lower edges of wall section 28B are curved at locations 80 (FIGS. 8 and 14), on both sides of the retaining structure 50, so as to merge smoothly into the tray floor 30, the must be formed with downwardly projecting extensions 82 in the regions between the guide ribs 59. These extensions permit surface 58 to be extended downwardly at locations 58A (FIG. 14), in order to match up with the adjacent guide ribs 72.

In order to limit the insertion of the bayonets into the interior wall spaces 34, and thus prevent the recesses 54 from riding past their proper location relative to the ribs 52, and also to prevent the projections 66 and 68 from riding past their proper locations with respect to the step structures 60, upper limiting shoulders 74 and lower limiting shoulders 76 are provided on the spacer section 42 of each connector-spacer member 24. The upper shoulders 74 strike against the bottom surfaces 84 of wall sections 28A and of extensions 82, thus limiting upward insertion of the up bayonets 38 into the interior wall spaces 34. Similarly, the lower shoulders 76 abut against the upper rim 32 of walls 28 in the regions surrounding the bayonets ports 44, for limiting downward insertion of the down bayonets 40.

It will therefore now be appreciated that the present invention provides a tray set including trays and connector members for connecting the trays in vertically stacked configuration, wherein each tray is sufficiently versatile to be used as an individual tray, as a topmost tray in a vertical stack, or as an intermediate or bottom tray in a vertical stack. Moreover, each tray can be converted freely between these various types of applications. When the removeable and replaceable plugs are placed within the bayonet ports, then the tray in question can be used individually or as the topmost tray in a vertical stack. When the plugs are removed from the bayonet ports, then the tray in question can be used as an intermediate or bottom tray in the vertical stack. Moreover, the removal of the plug is not irreversible, thus permitting the tray to be switched back to an individual or topmost stack application.

In addition, each tray is adapted to connect with the bayonets of spacer-connector members which plug in from above and/or from below. This permits each tray to be used either as a bottom member of the stack, or as a top member of the stack, or as an intermediate member which is required to receive both up and down bayonets simultaneously.

It should be understood that various changes and modifications to the preferred embodiments described herein will be apparent to those skilled in the art. Such changes and modifications can be made without departing from the spirit and scope of this invention and without substantially diminishing its attendant advantages. It is therefore intended that such changes and modifications be covered by the following claims.

We claim:

1. In a vertically stackable tray set of the type adapted to sit upon a horizontal surface and including at least one tray having upstanding wall means, at least one tray connector, at least one bayonet on said connector, and at least one space in the interior of said wall means for receiving said bayonet; the improvement comprising:

a first upright surface within said interior space and a first side of said bayonet having thereon respective means adapted to interfit;

and a second upright surface within said interior space, confronting said first upright surface, and a second side of said bayonet, facing oppositely to said first side thereof, having respective means thereon adapted to interengage for crowding said interfitting means into engagement with each other;

said interengaging means comprising respectively a projection extending horizontally into said interior space from said second upright surface thereof and a projection extending horizontally toward said second upright surface from said second side of said bayonet and adapted to impinge upon said projection of said second upright surface;

said projection on said second upright surface being in the form of a step having a horizontally facing tread surface and a vertically facing riser surface, and said projection on said second side of said bayonet being adapted to ride past said tread surface of said step and at least partly across said riser surface thereof.

2. A vertically stackable tray set adapted to sit upon a horizontal surface and comprising:

at least one tray having upstanding wall means;

at least one tray connector;

at least one up bayonet and at least one down bayonet on said connector;

and at least one space in the interior of said wall means for receiving both said bayonets;

a first upright surface within said interior space and a first side of each said bayonet having thereon respective means adapted for an interfit between each said bayonet and said first upright surface;

a second upright surface within said interior space, confronting said first upright surface, and a second side of each said bayonet, facing oppositely to said first side thereof, having respective means thereon adapted to interengage for crowding said interfitting means into engagement with each other;

said interengaging means on said second upright surface comprising a step having a tread surface facing in a horizontal direction and a riser surface facing in a first vertical direction; said interengaging means on the one side of said bayonets which extends in said first vertical direction comprising a projection which is adapted to ride past said tread surface of said step and at least partly across said riser surface thereof; and said interengaging means on the one of said bayonets which extends in a second vertical direction comprises a projection which is adapted to ride past said riser surface of said step and onto said tread surface thereof.

3. A vertically stackable tray set adapted to sit upon a horizontal surface and comprising:

at least one tray having upstanding wall means;

at least two tray connectors;

at least one up bayonet on one of said connectors and at least one down bayonet on the other of said connectors;

and at least one space in the interior of said wall means for receiving both said bayonets from opposite vertical directions;

a first upright surface within said interior space and a first side of each said bayonet having thereon respective means adapted for a snap interfit between each said bayonet and said first upright surface;

a second upright surface within said interior space, confronting said first upright surface thereof, and a second side of each of said bayonet, facing oppositely to said first side thereof, having respective means thereon adapted to interengage for crowding said snap interfitting means into engagement with each other;

said interengaging means on said second upright surface being in the form of a step having a tread surface facing in a horizontal direction and a riser surface facing in a vertical direction;

said interengaging means on said second side of one of said bayonets being opposite said snap interfitting means on said first side thereof;

said interengaging means on said second side of the other of said bayonets being offset from said snap interfitting means on said first side thereof;

said interengaging means on one of said bayonets being adapted to ride past said tread surface of said step and at least partly across said riser surface thereof;

4. A vertically stackable tray set adapted to sit upon a horizontal surface and comprising:

at least one tray having upstanding wall means;

at least one upper tray connector and at least one lower tray connector;

at least one up bayonet on said lower connector and at least one down bayonet on said upper connection;

at least one space in the interior of said wall means, and openings facing upwardly and downwardly respectively from said interior space for receiving both said up bayonet and said down bayonet;

a first upright surface within said interior space and a first side of each said bayonet having therein respective means adapted for an interfit between each said bayonet and said first upright surface;

a second upright surface within said interior space, confronting said first upright surface thereof, and a second side of each said bayonet, facing oppositely to said first side thereof, having respective means thereon adapted to interengage for crowding said interfitting means of each said bayonet and said first upright surface into engagement with each other;

said up and down bayonets being positioned relative to their respective connectors to be alongside of, and horizontally offset from, each other when received within said interior space.

5. A vertically stackable tray set adapted to sit upon a horizontal surface and comprising:

at least one tray having upstanding wall means;

at least one upper tray connector and at least one lower tray connector;

at least one up bayonet on said lower connector and at least one down bayonet on said upper connector;

at least one space in the interior of said wall means, and openings facing upwardly and downwardly respectively from said interior space for receiving both said up bayonet and said down bayonet;

and respective means within said interior space and on said upper and lower connectors for locating said connectors relative to said upward and downward openings respectively;

said up and down bayonets being positioned to be alongside of, and horizontally offset from, each other within said interior space when both said connectors are so located;

said down connector having a plurality of said up bayonets, said up connector having a plurality of said down bayonets, and said up bayonets being interdigitated with said down bayonets within said interior space when both said connectors are so located.

6. In a vertically stackable tray set of the type adapted to sit upon a horizontal surface and including at least one tray having upstanding wall means, at least one tray connector, at least one bayonet on said connector, and at least one space in the interior of said wall means for receiving said bayonet; the improvement comprising:

a first upright surface within said interior space and a first side of said bayonet having thereon respective means adapted for a snap interfit;

and a second upright surface within said interior space, confronting said first upright surface, and a second side of said bayonet, facing oppositely to said first side thereof, having respective means thereon adapted to interengage for crowding said snap interfitting means into engagement with each other, wherein said interengaging means comprise respectively a projection extending horizontally into said interior space from said second upright surface thereof and a projection extending horizontally toward said second upright surface from said second side of said bayonet and adapted to impinge upon said projection of said second upright surface, and said projection on said second upright surface being in the form of a step having a horizontally facing tread surface and a vertically facing riser surface, and said projection on said second side of said bayonet being adapted to ride past said riser surface of said step and onto said tread surface thereof.

* * * * *